US010498015B2

(12) United States Patent
Handy et al.

(10) Patent No.: US 10,498,015 B2
(45) Date of Patent: Dec. 3, 2019

(54) METHOD OF MAKING ARBITRARILY-SHAPED MULTIFUNCTIONAL STRUCTURE

(71) Applicant: SI2 Technologies, Inc., North Billerica, MA (US)

(72) Inventors: Erik S. Handy, Malden, MA (US); Joseph Michael Kunze, Chelmsford, MA (US)

(73) Assignee: SI2 Technologies, Inc., North Billerica, MA (US)

( * ) Notice: Subject to any disclaimer, the term of this patent is extended or adjusted under 35 U.S.C. 154(b) by 65 days.

(21) Appl. No.: 15/486,152

(22) Filed: Apr. 12, 2017

(65) Prior Publication Data

US 2017/0222307 A1 Aug. 3, 2017

Related U.S. Application Data

(60) Division of application No. 13/849,932, filed on Mar. 25, 2013, now Pat. No. 9,627,744, which is a (Continued)

(51) Int. Cl.
*H01Q 17/00* (2006.01)
*H01Q 1/28* (2006.01)
(Continued)

(52) U.S. Cl.
CPC ..... *H01Q 1/28* (2013.01); *H01Q 1/27* (2013.01); *H01Q 21/065* (2013.01); *Y10T 29/49016* (2015.01)

(58) Field of Classification Search
CPC ..... Y10T 29/49018; Y10T 29/49016; Y10T 29/49535; Y10T 29/49002; H01Q 21/0087; B65D 90/022
(Continued)

(56) References Cited

U.S. PATENT DOCUMENTS 3,633,206 A * 1/1972 McMillan ..... H01Q 19/06 343/754
5,039,992 A 8/1991 Lenormand et al.
(Continued)

FOREIGN PATENT DOCUMENTS

EP 0122619 B1 10/1984
WO 2006/043685 A1 4/2006

OTHER PUBLICATIONS

Auyeung, R.C.Y. et al., "Laser fabrication of GPS conformal antennas," Proc. of SPIE, vol. 5339, pp. 292-297 (2004).
(Continued)

*Primary Examiner* — Thiem D Phan
(74) *Attorney, Agent, or Firm* — Anthony A. Laurentano; Nelson Mullins Riley & Scarborough LLP

(57) ABSTRACT

Multifunctional structures and methods of manufacturing multifunctional structures which function as both electronic devices and load-bearing elements are disclosed. The load-bearing elements are designed to have electronic functionality using electronics designed to be load-bearing. The method of manufacturing the multifunctional structure comprises forming an electronic element directly on at least one ply of arbitrarily shaped load-bearing material using conventional lithographic techniques and/or direct write fabrication techniques, and assembling at least two plies of arbitrarily shaped load-bearing material into a multifunctional structure. The multifunctional structure may be part of an aerospace structure, part of a land vehicle, pan of a watercraft or part of a spacecraft.

5 Claims, 4 Drawing Sheets

Related U.S. Application Data continuation of application No. 11/672,972, filed on Feb. 9, 2007, now Pat. No. 8,405,561.

(60) Provisional application No. 60/887,692, filed on Feb. 1, 2007.

(51) Int. Cl.
*H01Q 21/06* (2006.01)
*H01Q 1/27* (2006.01)

(58) Field of Classification Search
USPC ..... 29/601, 592.1, 600; 219/529, 535; 343/700 MS, 705, 708, 709, 711, 713, 343/797, 872, 895
See application file for complete search history.

(56) References Cited

U.S. PATENT DOCUMENTS

| | | | | |
|---|---|---|---|---|
| 5,184,141 | A * | 2/1993 | Connolly | H01Q 1/005 244/126 |
| 5,405,107 | A | 4/1995 | Bruno | |
| 6,198,445 | B1 | 3/2001 | Alt et al. | |
| 6,407,711 | B1 | 6/2002 | Bonebright et al. | |
| 7,046,209 | B1 | 5/2006 | McCarville et al. | |
| 7,113,142 | B2 | 9/2006 | McCarville et al. | |
| 7,291,815 | B2 | 11/2007 | Hubert et al. | |
| 7,397,429 | B2 | 7/2008 | Crain et al. | |
| 7,624,951 | B1 | 12/2009 | Kraft et al. | |
| 7,642,974 | B2 | 1/2010 | Brady, Jr. et al. | |
| 7,701,403 | B2 | 4/2010 | Kebel et al. | |
| 7,760,149 | B2 | 7/2010 | Hook | |
| 8,059,043 | B2 | 11/2011 | Brady, Jr. et al. | |
| 8,405,561 | B2 | 3/2013 | Handy et al. | |
| 9,627,744 | B2 | 4/2017 | Handy et al. | |
| 2005/0054121 | A1 | 3/2005 | Handy et al. | |

OTHER PUBLICATIONS

Irwin, Bryan S. et al., "Direct-Write Processes as Enabling Tools for Novel Antenna Development," Materials Research Society Symposium Proceedings, vol. 698:Q3.4.1-Q3.4.5 (2002).

Lockyer, A.J. et al., "Design and development of a conformal load-bearing smart-akin antenna: overview of the AFRL Smart Skin Structures Technology Demonstration (S3TD)," Part of the SPIE Conference on Industrial and Commercial Applications of Smart Structures Technologies, SPIE, vol. 3674:410-424 (1999).

* cited by examiner

METHOD OF MAKING ARBITRARILY-SHAPED MULTIFUNCTIONAL STRUCTURE

CROSS-REFERENCE TO RELATED APPLICATIONS

This application is a Divisional of U.S. patent application Ser. No. 13/849,932 filed Mar. 25, 2013, now U.S. Pat. No. 9,627,744 issuing Apr. 18, 2017, which is a Continuation of U.S. patent application Ser. No. 11/672,972 filed Feb. 9, 2007, now U.S. Pat. No. 8,405,561 issuing Mar. 26, 2013, which claims priority to U.S. Provisional Application No. 60/887,692 filed Feb. 1, 2007 titled "Arbitrarily-Shaped Multifunctional Structures and Method of Making", which applications are incorporated herein by reference.

STATEMENT REGARDING FEDERALLY SPONSORED RESEARCH

This invention was made with United States Government support under contract F33615-03-M-3345 awarded by the U.S. Air Force. The U.S. Government may have certain interests to this application.

THE NAMES OF THE PARTIES TO A JOINT RESEARCH AGREEMENT

Not Applicable

INCORPORATION-BY-REFERENCE OF MATERIAL ON DISC

Not Applicable

BACKGROUND

1. Technical Field

The disclosure contained herein generally relates to multifunctional structures and methods of manufacturing multiply, multifunctional structures. In particular, the multifunctional structures of the disclosure function as both electronic devices and load-bearing elements.

2. Description of Related Art

Designs for vehicle and antenna systems aspire to a union of form and function: antennas that perform both structural and sensing roles. Such integrated technology could revolutionize intelligence, surveillance and reconnaissance equipment, enabling multiband, multimode detection for air, land and sea vehicles. Most current electronic antenna systems, however, are suboptimal and are often precluded from installation on smaller vehicles and protective gear due to the large size and weight of the required antennas.

Recent advances in materials and electronics as well as new design philosophies have resulted in a number of innovations. Antenna systems, for example, have been incorporated with the surfaces of load-bearing structures which may become elements of vehicles or protective equipment thereby resulting in unique multifunctional structures. Examples of such are the load-bearing antenna systems which are embedded in a vehicle structure. Incorporating or embedding the antenna into a surface of the vehicle structure helps to decrease the large space and weight burden typical of similar free-standing antennas.

This technology must be robust enough, however, to withstand a lifetime of harsh environmental conditions and a lifetime of flexure and material stresses. Moreover, the algorithms used to design antennas must be matured to guide the electronic elements over a curved surface. Thus, the design and manufacture of electronic devices that will be integrated with curved surfaces is both time consuming and expensive. For example, the electronic devices must be fabricated on substrates with known and consistent dielectric properties so that they function as expected and desired, in addition, conventional electronic fabrication techniques involve vacuum deposition, plating, etching and lamination which require the substrate material to be able to withstand high temperatures and/or chemical solutions; environments which may not be suitable for structural materials. Hence, the number of high performance electronic substrates currently available for use in multifunctional structures is limited.

The manufacture of these multifunctional structures has incorporated conventional electronic substrate materials either "as is" or with only slight modifications. Hence, these load-bearing antenna structures are not completely optimized, as the structural materials frequently do not have the required electronic properties, and the electronics are not fully integrated with the structure. Further, conventional electronic substrates typically do not exhibit the required mechanical properties such that they could tolerate significant in-service mechanical loads. Additionally, in order to make a useful, multifunctional structure which combines both electrical and mechanical properties, it is desirable to have the electronics conform to the shape of the structure. Conventional electronics manufacturing processes are limited in their ability to manufacture shape-conformal electronics.

Thus, the prior art approaches are able to fabricate structures and electronics using techniques and substrate materials which are industry limited. For example, a load-bearing wing structure is fabricated using techniques and materials which are standard for the aerospace composite industry. An electronic, device to be included on a wing structure is fabricated using materials standard for the electronics industry. As such, the electronic device would be formed on a substrate such as Kapton® or TR4 laminate and packaged in an enclosure (electronics box) to be placed somewhere inside the airplane or embedded in the wing composite material. Because the electronics are formed on a substrate which is not load-bearing, the embedded electronics will represent a mechanical defect for the wing. Thus, the previous approaches to fabrication of multifunctional devices either (1) embed the electronic element(s) directly onto the surface of the aircraft wing effectively creating a "hole" in the load-bearing structure or (2) deposit the electronic element(s) onto a ply of curable resin or other composite or laminate which is not load-bearing and which has been placed over the surface of the aircraft wing. The design of the aircraft wing and of the electronics may be easier using this conventional approach, but the performance of each component is compromised when the two are integrated (meshed together).

More innovative methods of incorporating electronic functions into vehicles, protective and military equipment are needed to make the aforementioned structures more efficient in meeting varied functional requirements simultaneously. Accordingly, there is a need for multifunctional structures and methods that enable fabrication of electronic elements directly on arbitrarily-shaped load-bearing materials while providing increased performance and functionality in the resulting multifunctional structures.

SUMMARY

The invention disclosed herein enables the manufacture of electronic elements directly on arbitrarily shaped load-bearing structural materials which, when assembled into a multifunctional structure, provide increased performance. As such, the disclosure describes systems and methods of manufacturing a multifunctional structure which may function as both an electronic device and a load-bearing element. Specifically, the load-bearing element is designed to have electronic functionality, and the electronics are designed to be load-bearing. The method of manufacturing the multifunctional structure comprises forming an electronic element directly on at least one ply of arbitrarily shaped load-bearing material using conventional lithographic techniques and/or direct write fabrication techniques. The electronic element is formed directly on the load-bearing material without any interposing layers or materials. The method further comprises placing at least two plies of the arbitrarily shaped load-bearing material adjacent to one another and in close contact to form a multifunctional structure. In a further step, the plies may be permanently attached to one another. This multifunctional structure may be, for example, part of a manned aerospace structure, part of an unmanned aerospace structure, part of a manned land vehicle, part of an unmanned land vehicle, part of a manned watercraft, part of an unmanned watercraft, part of a manned spacecraft or part of an unmanned spacecraft.

Thus, an embodiment of the disclosed invention is a method of manufacturing an arbitrarily shaped multifunctional structure. The method comprises the steps of providing a plurality of arbitrarily shaped load-bearing plies, forming at least one electronic element directly on at least one arbitrarily shaped load-bearing ply and placing at least two arbitrarily shaped load-bearing plies in adjacent close contact to form a multifunctional structure having an interior and an exterior, wherein the multifunctional structure is an electronic device and a load-bearing element. In a further step, the plies may be permanently attached to one another. The plies may be attached successively or all at once in a single attachment treatment.

In embodiments of the method, the electronic elements may be formed using conventional lithographic techniques, direct write fabrication techniques or a combination of both. The conventional lithographic techniques may comprise, for example, photolithography, screen printing, stencil printing, pad printing or gravure printing, while the direct write fabrication techniques may comprise, for example, micropen dispensing, ink jet dispensing, thermal spray dispensing, laser transfer, laser micromachining, laser mill and fill, or dip-pen nanolithography.

In additional embodiments of the method, the electronic elements may be formed using at least electrically-conductive inks, dielectric inks, semiconductor materials, semiconductor devices, or combinations thereof. Further, the materials that make up the arbitrarily shaped load-bearing plies of the multifunctional structure may be composite materials. These composite materials may be made from several separate materials, which may comprise, for example, organic resins, inorganic fibers, organic fibers or combinations thereof In embodiments, the organic resin may be selected from at least bismaleimide, a vinyl ester resin, an epoxy resin, a phenolic resin, a cyanate ester resin or a silicone resin. The inorganic fiber may be selected from at least mineral fiber, ceramic fiber, glass fiber, quartz fiber, carbon fiber or graphite fiber. The organic fiber may be selected from at least plant based or animal based fiber, polyamide fiber, polyimide fiber, polyvinyl alcohol fiber, polyester fiber, rayon, polyacrylonitrile fiber, polybenzimidazole fiber, polyalkylene fiber, and polyolefin fiber.

In another embodiment of the method, the multifunctional structure which is manufactured may be at least a fuselage, fin, nosecone, radome, wing, aileron, flap, elevator, stabilizer, ruddervator, fairing, access panel, hatch, spar, strut, skin, missile, bus of a missile, munition, mortar, manned aerospace structure, unmanned aerospace structure, satellite, bus of a satellite, aerospace platform, body armor, a helmet, a shelter, footwear, part of a manned land vehicle, part of an unmanned land vehicle, part of a manned watercraft, part of an unmanned watercraft, part of a manned spacecraft or part of an unmanned spacecraft. The manned or unmanned aerospace structure may have wings which are fixed or rotary. Further, the manned or unmanned land vehicle may be a tank, a personnel carrier, a humvee or armored vehicle, while the manned or unmanned watercraft may operate at the surface of the water, under the water, on land or a combination thereof. The multifunctional structure which is manufactured may also be non-military equipment, such as non-recreational vehicles, recreational vehicles and sporting equipment. The recreational vehicles may comprise, for example, cars, trucks, boats, aircraft with engines, aircraft without engines, snow mobiles, jet skis and all terrain vehicles. The non-recreational vehicles may comprise, for example, cars, buses or trucks. The sporting equipment may include, but is not limited to, sporting equipment that may be worn as protective gear or equipment that is used in a sport.

In yet another embodiment of the method, the electronic element formed on the arbitrarily shaped load-bearing ply or plies may be at least amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof. The electronic element formed on the arbitrarily shaped load-bearing ply or plies may further include at least sensor arrays, detectors, micro-electromechanical devices and RF devices. Further, in embodiments wherein the electronic element is a sensor, the sensor may be an antenna, a thermocouple, a resistive temperature device, a strain sensor, a strain gauge, a temperature sensor, a velocity sensor, a pressure sensor, a crack sensor, a chemical sensor or a biological sensor.

In embodiments where the electronic element is an RF device, the RF device may comprise an antenna system, a frequency-selective surface or a transmission line. The antenna system may comprise an antenna element or array of antenna elements and electronic circuitry to support the operation of the antenna element or array of antenna elements. Further, the antenna system may function as a global positioning system (GPS), communications system, datalink system, telemetry system, radar system, directed energy system or RFID antenna system. These lists of electronic elements and devices are for illustrative purposes only, and are not meant to be limiting as to the scope and range of elements, and devices that may be incorporated as part of embodiments of this disclosure.

In additional embodiments of the method, the electronic elements may reside on the interior, exterior or a combination thereof in the final multifunctional structure. Further, the material for the arbitrarily shaped load-bearing plies may be selected based on mechanical properties and electronic properties. The electronic properties may comprise dielectric constant, loss tangent, moisture absorption and conductivity, while the mechanical properties may comprise strength, toughness, stillness, glass transition temperature, heat distortion temperature, melting temperature, density and decomposition temperature.

Another embodiment of the disclosed invention is an arbitrarily shaped load-bearing antenna system produced by a process comprising the steps of providing a plurality of arbitrarily shaped load-bearing plies, forming at least, one antenna system component directly on at least one arbitrarily shaped load-bearing ply, placing at least two arbitrarily shaped load-bearing plies in adjacent close contact, and attaching the arbitrarily shaped load-bearing plies to each other. These arbitrarily shaped load-bearing plies are assembled such that none of the antenna system component (s) reside on an external surface of the arbitrarily shaped load-bearing antenna. The arbitrarily shaped load-bearing antenna produced by the process of this embodiment functions as both an antenna system and a load-bearing structure. In embodiments, the antenna system may function as at least a global positioning system, communications system, data-link system, a telemetry system, radar system, directed energy system or RFID antenna system.

In additional embodiments of the system, the at least one antenna system component may be formed using electrically-conductive inks, dielectric inks, semiconductor materials, semiconductor devices, or combinations thereof. Further, the at least one antenna system component may be formed using conventional lithographic techniques, direct write fabrication techniques or combinations thereof. The conventional lithographic techniques may comprise photolithography, screen printing, stencil printing, pad printing and gravure printing, while the direct write fabrication techniques may comprise micropen dispensing, ink jet dispensing, thermal spray dispensing, laser transfer, laser micromachining, laser mill and fill and dip-pen nanolithography.

In additional embodiments of the system, the material of the load-bearing plies may be composite materials. These composite materials may be made from several separate materials, which may comprise, for example, organic resins, inorganic, fibers, organic fibers or combinations thereof In embodiments, the organic resin may be selected from at least bismaleimide, a vinyl ester resin, an epoxy resin, a phenolic resin, a cyanate ester resin or a silicone resin. The inorganic fiber may be selected from at least mineral fiber, ceramic fiber, glass fiber, quart, fiber, carbon, fiber or graphite fiber. The organic fiber may be selected from at least plant based or animal based fiber, polyamide fiber, polyimide fiber, polyvinyl-alcohol fiber, polyester fiber, rayon, polyacrylonitrile fiber, polybenzimidazole fiber, polyalkylene fiber, and polyolefin fiber. Further, the material of the load-bearing plies may be selected based on mechanical properties and electronic properties, wherein the electronic properties may comprise dielectric constant, loss tangent, moisture absorption and conductivity, and the mechanical properties may comprise strength, toughness, stillness, glass transition temperature, heat distortion temperature, melting temperature, density and decomposition temperature.

In yet further embodiments of the system, the arbitrarily shaped load-bearing antenna formed by the process may be at least a fuselage, fin, nosecone, radome, wing, aileron, flap, elevator, stabilizer, ruddervator, fairing, access panel, hatch, spar, strut, skin, missile, bus of a missile, munition, mortar, manned aerospace structure, unmanned aerospace structure, satellite, bus of a satellite, aerospace platform, body armor, a helmet, a shelter, footwear, part of a manned land vehicle, part of an unmanned land vehicle, part of a manned watercraft, part of an unmanned watercraft, part of a manned spacecraft or part of an unmanned spacecraft. The manned or unmanned aerospace structure may have wings which are fixed or rotary. Further, the manned or unmanned land vehicle may be a tank, a personnel carrier, a humvee or armored vehicle, while the manned or unmanned watercraft may operate at the surface of the water, under the water, on land or a combination thereof.

The multifunctional structure which, is manufactured may also be non-military equipment, such as non-recreational vehicles, recreational vehicles and sporting equipment. The recreational vehicles may comprise, for example, cars, trucks, boats, aircraft with engines, aircraft without engines, snow mobiles, jet skis and all terrain vehicles. The non-recreational vehicles may comprise, for example, cars, buses and trucks. The sporting equipment may include, but is not limited to, sporting equipment that may be wont as protective gear or equipment that is used in a sport. In embodiments, the at least one antenna system component may be an amplifier, integrated circuit, memory device, switch, circulator, filter, transmit/receive module, resistor, capacitor, inductor, transmission line, signal line and power line.

Yet another embodiment of the disclosed invention is a multifunctional load-bearing antenna structure comprising at least two arbitrarily shaped load-bearing plies, wherein the first arbitrarily shaped load-bearing ply comprises at least one antenna system component formed directly on a first surface and the second arbitrarily shaped load-bearing ply is placed adjacent to and in close contact with the first surface of the first arbitrarily shaped load-bearing ply. In embodiments, the second arbitrarily shaped load-bearing ply may further comprise at least one antenna system component formed directly on a second surface, wherein the second surface of the second arbitrarily shaped load-bearing ply faces the first surface of the first arbitrarily shaped load-bearing ply. In a further step, the plies may be permanently attached to one another. The plies may be attached successively or all at once in a single attachment treatment.

In embodiments of the multifunctional load-bearing antenna structure, the at least one antenna system component may be selected from at least amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof. Further, the arbitrarily shaped load-bearing antenna structure may function as at least a global positioning system, communications system, data-link system, a telemetry system, radar system, directed energy system or RFID antenna system.

In additional embodiments of the multifunctional load-bearing antenna structure, the material of the load-bearing plies may be composite materials. These composite materials may be made from several separate materials, which may comprise, for example, organic resins, inorganic fibers, organic fibers or combinations thereof. In embodiments, the organic resin may be selected from at least bismaleimide, a vinyl ester resin, an epoxy resin, a phenolic resin, a cyanate ester resin or a silicone resin. The inorganic fiber may be selected from at least mineral fiber, ceramic fiber, glass fiber, quartz fiber, carbon fiber or graphite fiber. The organic fiber may be selected from at least plant based or animal based fiber, polyamide fiber, polyimide fiber, polyvinyl alcohol fiber, polyester fiber, rayon, polyacrylonitrile fiber, polybenzimidazole fiber, polyalkylene fiber, and polyolefin fiber.

In further embodiments of the multifunctional load-bearing antenna structure, the arbitrarily shaped load-bearing antenna structure may be at least a fuselage, fin, nosecone, radome, wing, aileron, flap, elevator, stabilizer, ruddervator, fairing, access panel, hatch, spar, strut, skin, missile, bus of a missile, munition, mortar, manned aerospace structure, unmanned aerospace structure, satellite, bus of a satellite, aerospace platform, body armor, a helmet, a shelter, footwear, part of a manned land vehicle, part of an unmanned land vehicle, part of a manned watercraft, part of an unmanned watercraft, part of a manned spacecraft or part, of an unmanned spacecraft. The manned or unmanned aerospace structure may have wings which are fixed or rotary. Further, the manned or unmanned land vehicle may be a tank, a personnel carrier, a humvee or armored vehicle, while the manned or unmanned watercraft may operate at the surface of the water, under the water, on land or a combination thereof. The multifunctional structure which is manufactured may also be non-military equipment, such as non-recreational vehicles, recreational vehicles and sporting equipment. The recreational vehicles may comprise, for example, cars, trucks, boats, aircraft with engines, aircraft without engines, snow mobiles, jet skis and all terrain vehicles. The non-recreational vehicles may comprise, for example, cars, buses and trucks. The sporting equipment may include, but is not limited to, sporting equipment that may be worn as protective gear or equipment that is used in a sport.

BRIEF DESCRIPTION OF SEVERAL VIEWS OF THE DRAWINGS

For a better understanding of the disclosure and to show how the same may be carried into effect, reference will now be made to the accompanying drawings. It is stressed that the particulars shown are by way of example only and for purposes of illustrative discussion of the various embodiments of the presently disclosed invention only, and are presented in the cause of providing what is believed to be the most useful and readily understood description of the principles and conceptual aspects of the invention. In this regard, no attempt is made to show structural details of the disclosed invention in more detail than is necessary for a fundamental understanding of the invention, the description taken with the drawings making apparent to those skilled in the art how the several forms of the invention may be embodied in practice, in the accompanying drawings.

DETAILED DESCRIPTION

Before the present devices, systems and methods are described, it is to be understood that this invention is not limited to the particular processes, devices, or methodologies described, as these may vary. It is also to be understood that the terminology used in the description is for the purpose of describing the particular versions or embodiments only, and is not intended to limit the scope of the present disclosure which will be limited only by the appended claims.

It must also be noted that as used herein and in the appended claims, the singular forms "a", "an", and "the" include plural reference unless the context clearly dictates otherwise. Thus, for example, reference to a "device" is a reference to one or more devices and equivalents thereof known to those skilled in the art, and so forth. "Optional" or "optionally" means that the subsequently described structure, event or circumstance may or may not occur, and that the description includes instances where the structure, event or circumstance occurs and instances where it does not. Unless defined otherwise, all technical and scientific terms used herein have the same meanings as commonly understood by one of ordinary skill in the art.

The term "conformal," as used herein, may be taken to indicate a mapping of a surface or region upon another surface so that all angles between intersecting curves remain unchanged. Thus, an electronic element which is formed conformally onto a substrate, such as an aircraft wing, will follow the contours of that surface. The above terminology is familiar to those in the art.

Although any methods and materials similar or equivalent to those described herein can, be used in the practice or testing of embodiments of the disclosed invention, the preferred methods, devices, and materials are now described. All publications mentioned herein are incorporated by reference in their entirety.

Figure 1:
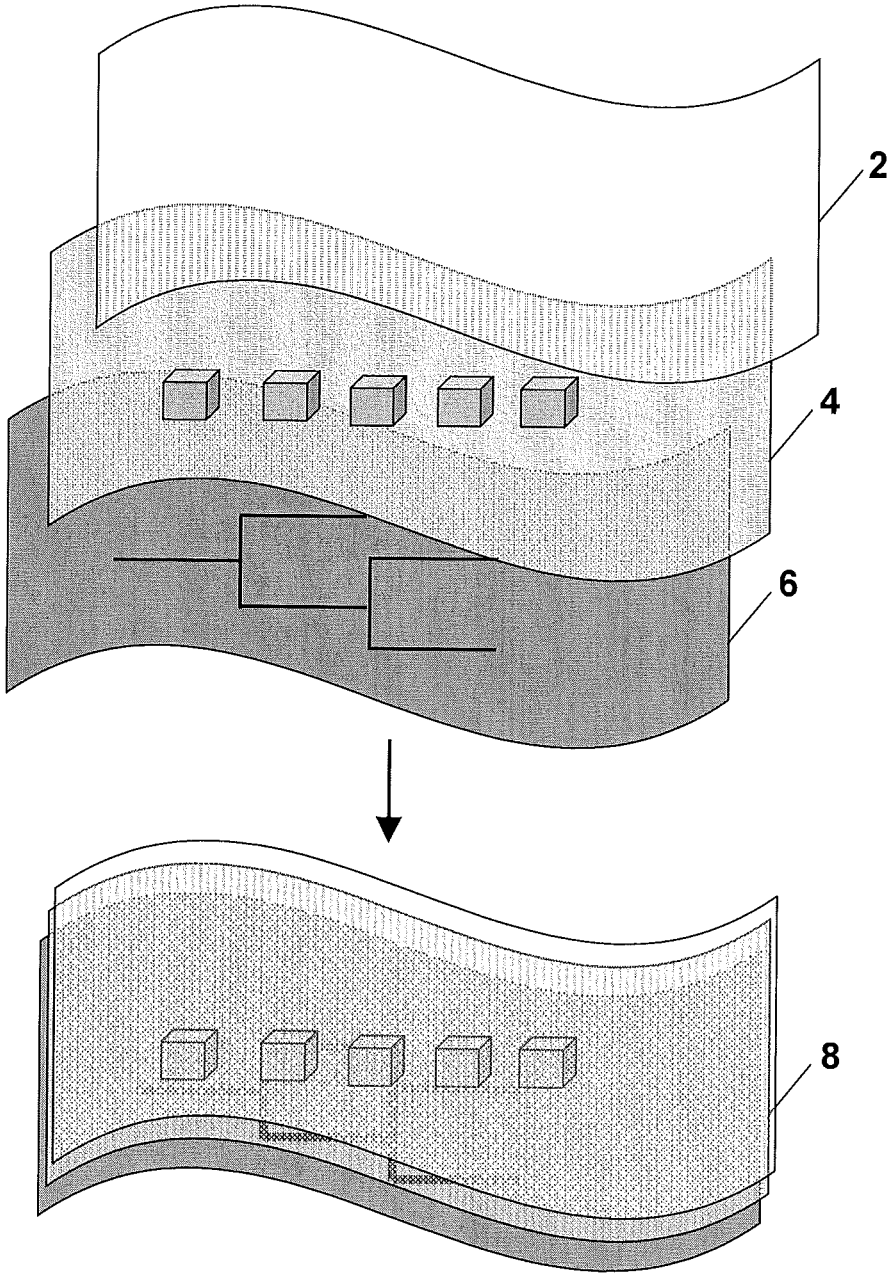
FIG. 1 is a schematic diagram which illustrates various embodiments of a multifunctional composite structure.

The disclosed invention is directed to a method of manufacturing an arbitrarily shaped multifunctional structure. The disclosure relates to the design of multilayer or multi-ply structures which contain electronic elements. Each ply or layer may be an arbitrarily shaped load-bearing material and may have an electronic element or several, electronic elements conformally formed directly thereon, using either direct write or conventional lithographic techniques or both. The electronic elements may be formed directly on the load-bearing plies without any interposing layers. These plies are then assembled into a load-bearing structure by placing them adjacent to one another and in close contact. With reference to FIG. 1, individual load-bearing plies (2, 4 and 6) may have electronic elements formed directly thereon; such as on plies 4 and 6. These, plies are then attached or bonded to one another to form the final multifunctional structure (H).

As used herein, use of the phrase "formed directly thereon" shall be taken to indicate that, no interposing layers are incorporated on the multifunctional structure. Further, the term "interposer" refers to an interposing or intervening layer or ply which is provided for the sole purpose of supporting an electronic element, and which does not provide load-bearing capacity. As such, an interposer is an interposing layer which is not and does not function, as a load-bearing ply (e.g. is not able to tolerate mechanical loads). Thus, forming an electronic element directly on a load-bearing ply indicates that the element is deposited or patterned directly onto the surface of the load-bearing ply without an interposer.

Assembly of the plies may occur successively or all at once. For example, after an electronic device is formed on a first ply (6), the first ply may be attached or laminated onto a second ply (4). An additional electronic element may optionally be formed on the second ply (4), and this composite of two plies may then be attached or laminated to a third ply (2) or grouping of any number of additional plies. Attachment of the plies may be a permanent attachment or a semi-permanent attachment. Treatments which may bond the plies at successive steps or all at once into a single structure include, but are not limited to, increased pressure, decreased pressure, exposure to certain wavelengths of light, chemical treatment, or a change in an environmental condition such as, for example, humidity or temperature. The selection of a bonding treatment may be based on the composite materials selected for the arbitrarily shaped load-bearing plies, such that the bonding treatment would preferably not result in a reduction in material integrity.

A multilayer, multifunctional structure manufactured by this method demonstrates improved capabilities as a load-bearing structure while maintaining a highly efficient design and functionality for the electronic device. Considerations of the materials that form the individual plies of the structure must be made in the overall design of the structure. Thus, the material that forms the functional load-bearing components of the article (the load-bearing plies) is also responsible for the functional aspects of the structure (the electronic device).

As used herein, the term "ply" may be taken to refer to an individual structural layer or ply of load-bearing material. Several plies of load-bearing material may be used to form a single panel. A functional structure may comprise a single panel, or a sandwich of several panels, Examples of a functional structure include, but are not limited to, a fuselage, fin, nosecone, radome, wing, aileron, flap, elevator, stabilizer, ruddervator, fairing, access panel, hatch, spar, strut, skin, missile, bus of a missile, munition, mortar, manned aerospace structure, unmanned aerospace structure, satellite, bus of a satellite, aerospace platform, body armor, a helmet, a shelter, footwear, part of a manned land vehicle, part of an unmanned land vehicle, part of a manned watercraft or part of an unmanned watercraft. The manned or unmanned aerospace structure may have wings which are fixed or rotary. Further, the manned or unmanned land vehicle may be a tank, a personnel carrier, a humvee or armored vehicle, while the manned or unmanned watercraft may operate at the surface of the water, under the water, on land or a combination thereof. The multifunctional structure which is manufactured may also be non-military equipment, such as non-recreational vehicles, recreational vehicles and sporting equipment. The recreational vehicles may comprise, for example, cars, trucks, boats, aircraft with engines, aircraft without engines, snow mobiles, jet skis and all terrain vehicles. The non-recreational vehicles may comprise, for example, cars, buses and trucks. The sporting equipment may include, but is not limited to, sporting equipment that may be worn as protective gear or equipment that is used in a sport.

The layers or plies of load-bearing material of the invention may be composite materials made from two or more constituent, materials. These constituent materials may have different physical or chemical properties and may remain distinct within the finished structure. The load-bearing material may comprise, for example, organic resins, inorganic fibers, organic fibers or combinations thereof, in embodiments, the organic resin may comprise, for example, bismaleimide, a vinyl ester resin, an epoxy resin, a phenolic resin, a cyanate ester resin or a silicone resin. The inorganic fiber may comprise, for example, a mineral fiber, a ceramic fiber, a glass fiber, a quartz fiber, a carbon fiber or a graphite fiber. The organic fiber may comprise, for example, a plant, based fiber, an animal based fiber, a polyamide fiber, a polyimide fiber, a polyvinyl alcohol fiber, a polyester fiber, a rayon, a polyacrylonitrile fiber, a polybenzimidazole fiber, a polyalkylene fiber and a polyolefin fiber.

The materials utilized as the individual load-bearing material plies may be selected on the basis of their mechanical and electronic properties. The electronic properties may comprise, for example, a dielectric constant, a loss tangent, a moisture absorption and a conductivity, while the mechanical properties may comprise at least strength, stiffness, glass transition temperature, heat distortion temperature, melting temperature and decomposition temperature.

As used herein, the term "device" may denote a single device (e.g., an individual transistor, integrated circuit, memory device, low-noise amplifier, power amplifier, switch, circulator, filter, transmit/receive module, resistor, capacitor, inductor, transmission line, signal line, power line, or micro-electromechanical device) or a multi-device component. Multi-device components may include phased arrays, display backplanes or photo-detectors, for example, which are made up of multiple devices fabricated as part of a multifunctional structure using methods of the present disclosure. An electronic device of the disclosure may comprise a single electronic element or more than one electronic element.

A variety of electronic elements or devices such as, but not limited to, amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof, may be formed on an arbitrarily shaped load-bearing material ply using methods of the present disclosure. The electronic element may further include at least sensor arrays, detectors, micro-electromechanical devices and RF devices. Further, in embodiments wherein the electronic element is a sensor, the sensor may include an antenna, a thermocouple, a resistive temperature device, a strain sensor, a strain gauge, a temperature sensor, a velocity sensor, a pressure sensor, a crack sensor, a chemical sensor or a biological sensor. In embodiments where the electronic element is an RF device, the RF device may include an antenna system, a frequency-selective surface or a transmission line. The antenna system may comprise an antenna element or array of antenna elements and electronic circuitry to support the operation of the antenna clement or array of antenna elements. Further, the antenna system may function as a global positioning system (GPS), communications system, data-link system, telemetry system, radar system, directed energy system or RFID antenna system. These lists of electronic elements and devices are for illustrative purposes only, and are not meant to be limiting as to the scope and range of elements and devices that may be incorporated as part of embodiments of this disclosure.

The electronic elements that make up an electronic device may be formed on surfaces of the load-bearing plies which are placed so that they become part of the exterior or interior of the final multi-functional structure. If the electronic elements require contact with the external environment to sample an aspect of the environment such as, for example, humidity or the presence of a biological or chemical substance, they may be placed on an external surface. Examples of such electronic devices are chemical and biological sensors. If the electronic elements do not need to directly sample the environment, or need to be protected from the environment, they may be placed on a ply surface which is not an external surface of the multifunctional structure. In other words, the surfaces of the plies on which these electronic elements are deposited will be part of the interior of the final multifunctional structure. Furthermore, a portion of an electronic device or element may require contact with the external environment while another portion(s) may need to be protected from the external environment. Using a temperature sensor as an example, the sensing clement(s) may require exposure to the external environment and may therefore reside on an external surface of the multifunctional structure while the electronic elements of the sensor may reside on the interior of the multifunctional structure In the multifunctional structure, the electronic elements are formed directly on the arbitrarily shaped load-bearing plies using direct write and/or conventional lithographic techniques. As used herein, the term "direct write" refers generally to any technique for creating a pattern directly on a substrate, either by adding material to or removing material from the substrate, without the use of a mask or preexisting form. Such techniques include at least micropen dispensing, ink jet dispensing, thermal spray dispensing, laser transfer, laser micromachining, laser mill and fill, and dip-pen nanolithography. The direct write patterning of the present disclosure may also combine several process steps (including, but not limited to deposition of metallic films and photo resists, lithography, etch and strip) into one process step that can be implemented at atmospheric pressure and room temperature.

Direct write technologies have been developed in response to a need in the electronics industry for a means to rapidly prototype passive circuit elements on various substrates, especially in the mesoscopic regime; that is, electronic devices that straddle the size range between conventional microelectronics (sub-micron-range) and traditional surface mount components (10+mm-range). Direct writing allows for circuits to be prototyped without iterations in photolithographic mask design and allows the rapid evaluation of the performance of circuits too difficult to accurately model. Most direct write processes operate in an ambient environment, thus high-rate production processes (such as roll-to-roll and sheet-to-sheet processes) may be enabled for electronic components that previously had to be processed in batches under controlled environments such as vacuum. Further, direct writing allows for the size of printed circuit boards and other structures to be reduced by allowing passive circuit elements to be conformably incorporated into the structure. Direct writing may be controlled with computer aided design/computer aided manufacturing (CAD/CAM) programs, thereby allowing electronic circuits to be fabricated by machinery operated by unskilled personnel or allowing designers to move quickly from a design to a working prototype. Other applications of direct write technologies in microelectronics fabrication include forming ohmic contacts, forming interconnects for circuits, forming vias, device restructuring and customization.

The term "conventional lithography" refers to a deposition or printing method in which the printing and nonprinting areas exist on the same plane, and printing is affected by means of a process (physical or chemical) that allows ink or other substance to adhere to only the parts of the surface to be reproduced. Conventional lithographic techniques include, but are not limited to, photolithography, screen printing, stencil printing, pad printing, soft lithography and gravure printing. The term "soft lithography" includes micro-contact printing, micro-transfer printing, micro-molding in capillary (MIMIC) and solvent-assisted micro-molding. In this process, patterns of organic compounds or organic materials are transferred onto a substrate using an elastomeric stamp or mold with fine patterns. In the soft lithography process, a self-assembled monolayer of specific compounds is formed on a substrate by a contact printing process, and a fine structure is formed by an embossing process (imprinting process) and a replica molding process.

A control mechanism may be used to control the source of the energy beam used by the direct write or conventional lithography techniques. This control mechanism may function by changing the relative position of the energy beam with respect to either substrate (e.g. inks and load-bearing materials), by regulating the size and shape of the cross-section of the energy beam, and by regulating the fluence (energy density) or movement of the energy beam. The control mechanism may include a CAD/CAM system known to those skilled in the art and a computer in addition to the load-bearing material, energy beam positioners and load-bearing material holders as would be known to those skilled in the art. Standard CAM/CAD controllers, software, and translation stages may be used as would be known to one skilled the art for making a controllable system for movement of the energetic beam(s) and the receiving substrate (the load-bearing material ply).

Thus, an embodiment of the invention is a method of manufacturing a multifunctional structure. The method comprises providing a plurality of arbitrarily shaped load-bearing plies, forming at least one electronic element directly onto at least one load-bearing ply without an interposer, and placing at least two load-bearing plies in close contact to form a multifunctional structure with an exterior and an interior. The multifunctional structure formed by this method functions as an electronic device and a load-bearing element. In various embodiments, the electronic element may be formed using conventional lithographic techniques, direct write fabrication techniques or a combination of both. In various embodiments, the electronic element may be formed on a single surface of the load-bearing ply, or on more than one surface of the load-bearing ply, such as, for example, on opposite sides. Assembly of the at least two load-bearing plies causes the plies to be in adjacent close contact with each other. In a further step, the plies may be permanently attached to one another successively or all at once in a single attachment treatment.

In embodiments, the electronic elements may be formed by depositing electrically-conductive inks, dielectric inks, semiconductor materials, semiconductor devices, or a combination thereof. Further, the layers or plies of load-bearing material of the invention may be composite materials made from two or more constituent materials. These constituent materials may have different physical or chemical properties and may remain distinct within the finished structure. The load-bearing material may comprise, for example, organic resins, inorganic fibers, organic fibers or combinations thereof. In embodiments, the organic resin may be selected from at least bismaleimide, a vinyl ester resin, an epoxy resin, a phenolic resin, a cyanate ester resin or a silicone resin. The inorganic fiber may be selected from at least mineral fiber, ceramic fiber, glass fiber, quartz fiber, carbon fiber or graphite fiber. The organic fiber may be selected from at least plant based or animal based fiber, polyamide fiber, polyimide fiber, polyvinyl alcohol, fiber, polyester fiber, rayon, polyacrylonitrile fiber, polybenzonimidazole fiber, polyalkylene fiber, and polyolefin fiber.

The materials selected for use as the load-bearing ply may be selected on the basis of their mechanical and electronic properties. The electronic properties may comprise at least dielectric constant, loss tangent, moisture absorption and conductivity, while the mechanical properties may comprise at least strength, stiffness, glass transition temperature, heat distortion temperature, melting temperature and decomposition temperature.

In embodiments, the electronic elements or devices which may be formed on the load-bearing material include, but are nor limited to, amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof, may be formed on an arbitrarily shaped load-bearing material ply using methods of the present disclosure. The electronic element may further include at least sensor arrays, detectors, micro-electromechanical devices and RF devices. Further, in embodiments wherein the electronic element is a sensor, the sensor may be at least an antenna, a thermocouple, a resistive temperature device, a strain sensor, a strain gauge, a temperature sensor, a velocity sensor, a pressure sensor, a crack sensor, a chemical sensor or a biological sensor. In embodiments where the electronic element is an RF device, the RF device may be at least an antenna system, a frequency-selective surface or a transmission line. The antenna system may comprise an antenna element or array of antenna elements and electronic circuitry to support the operation of the antenna element or array of antenna elements. Further, the antenna system may function as at least a global positioning system (GPS), communications system, data-link system, telemetry system, radar system, directed energy system or RFID antenna system. These lists of electronic elements and devices are for illustrative purposes only, and are not meant to be limiting as to the scope and range of elements and devices that may be incorporated as part of embodiments of this disclosure.

An exemplary multifunctional structure manufactured according to an embodiment may include a composite aircraft wing of an unmanned aerial vehicle (UAV) which contains an antenna. The antenna of the UAV, designed by methods of the disclosure, may have enhanced surveillance capabilities as the antenna may be directly integrated with the primary load-bearing structure of the composite aircraft wing and may occupy a larger surface area than previously available as a free standing component. In an embodiment, such antennas may be as large as the surface area of a wing and be sufficiently sensitive to simultaneously detect ground-moving targets and track air-to-air missile threats. The large surface area dedicated to such an antenna may provide the needed gain and coverage to detect slow moving targets masked by heavy jungle foliage: a task previously deemed impossible with conventional antennas.

The fabrication of the antenna using methods of the present disclosure may also provide for the required load-bearing capabilities of the composite aircraft wing. The electronic elements are incorporated directly on load-bearing plies which, when assembled, form a portion of the composite aircraft wing, or the whole aircraft wing. That is, the materials which are chosen for each of the load-bearing plies of the structure may perform two functions. They provide load-bearing capacity in the final multifunctional structure and function as an integral part of the electronic device, such as, for example, providing a ground plane. Thus, the material that forms a functional load-bearing component of the article (the load-bearing ply) may also be responsible for functional aspects of the structure (the electronic device). The disclosed invention provides a unique method of manufacturing multifunctional, conformal electronic structures which integrates the overall structural and electronic designs into a single structure.

Further examples of such multifunctional structures which may be fabricated by methods of the disclosed invention may include a fuselage, fin, nose-cone, radome, wing, aileron, flap, elevator, stabilizer, ruddervator, fairing, access panel, hatch, spar, strut, skin, missile, bus of a missile, munition, mortar, manned aerospace structure, unmanned aerospace structure, satellite, bus of a satellite, aerospace platform, body armor, a helmet, a shelter, footwear, part of a manned land vehicle, part of an unmanned land vehicle, part of a manned watercraft or part of an unmanned watercraft. The manned or unmanned aerospace structure may have wings which are fixed or rotary. Further, the manned or unmanned land vehicle may comprise, for example, a tank, a personnel, carrier, a humvee or armored vehicle, while the manned or unmanned watercraft may operate at the surface of the water, under the water, on land or a combination thereof. The multifunctional structure which is manufactured may also be non-military equipment, such as non-recreational vehicles, recreational vehicles and sporting equipment. The recreational vehicles may comprise, for example, cars, trucks, boats, aircraft with engines, aircraft without engines, snow mobiles, jet skis and all terrain vehicles. The non-recreational vehicles may comprise, for example, cars, buses and trucks. The sporting equipment may include, but is not limited to, sporting equipment that may be worn as protective gear or equipment that is used in a sport. A multifunctional structure which may be fabricated by methods of the present disclosure may function as a sensor or an RF device.

The disclosed invention also provides methods for the direct patterning of high-conductivity metals on curved surfaces. Direct write conductive patterns are typically formed using lower conductivity metal-based inks (e.g., electrically-conductive silver ink or gold paste deposited using, fluid dispensers). After a low-temperature processing or UV-curing step, low and high-conductivity printed ink patterns may be ready to use, but do not have the conductivity of bulk metal foils (e.g., copper). However, in an embodiment, direct patterning of both low and high-conductivity bulk metals on curved surfaces may be performed after metal deposition (e.g., deposition by thermal evaporation, sputtering or foil lamination). That is, metals and other etchable materials may be etched without the need for photolithographic masks, which are expensive and not well-suited for lithographic patterning of non-planar substrates. Photolithographic masks are particularly ill-suited to the prototyping process where many iterations and therefore many masks may be required. Rather, patterns may be formed directly onto substrates which are already curved using direct write techniques, eliminating the danger that fine pattern features may be damaged if the substrate is bent into the desire shape after pattern formation. Metal etchant solution (e.g., for copper foil) may be formulated as a high-viscosity gel, which may then be printed onto a metal-coated substrate using a computer-driven dispensing system such as a micropen dispenser, in a specific XYZ pattern using a motorized stage. This brings about patterned etching of the metal without the need for etch-blockers, etch resists, or immersion of the whole part in an etching bath.

Alternatively, the XYZ-driven dispensing system may be used to print a photoresist pattern onto a surface without the need for a spin-coater to apply the photoresist or a shadow-mask to photo-pattern the photoresist. After patterned printing of the photoresist material, the metal or other material ply can be etched in the standard way, e.g., by immersion in etchant solution or exposure to a plasma etchant. Whether etchant gel or photoresist is dispensed, these materials may be directly written onto planar, curved, or flexible substrates in any pattern so as to achieve a desired pattern of the underlying etchable material.

As discussed above, direct write includes a family of techniques that allows for "printing" of electronic materials onto flat, flexible or conformal substrates of interest at relatively low temperatures without the need for tooling, masks, chemical etchants, or special atmospheres. As such, direct write processes can be used to deposit electronic materials directly onto a large number of substrate materials, such as load-bearing composite structures, without subjecting the substrate to harsh processing conditions. Processing conditions such as high temperature or chemicals may degrade the performance of a load-bearing material ply. However, the ability to deposit material directly onto most substrates does not guarantee that the fabricated device will function as desired, as the dielectric properties of the substrate may not be known or consistently reproducible from part to part. To overcome this, the disclosed invention makes use of both direct write additive processes and laser micromachining (as a subtractive process). The disclosed invention also makes use of direct write for the patterning of low and high-conductivity metals onto curved surfaces. Thus, one may selectively add or remove material from the substrate of interest. Doing so permits the performance of the electronic device to be tuned to the desired specifications. Again, this is accomplished without subjecting the substrate to the harsh environments of conventional electronics processing.

Figure 2:
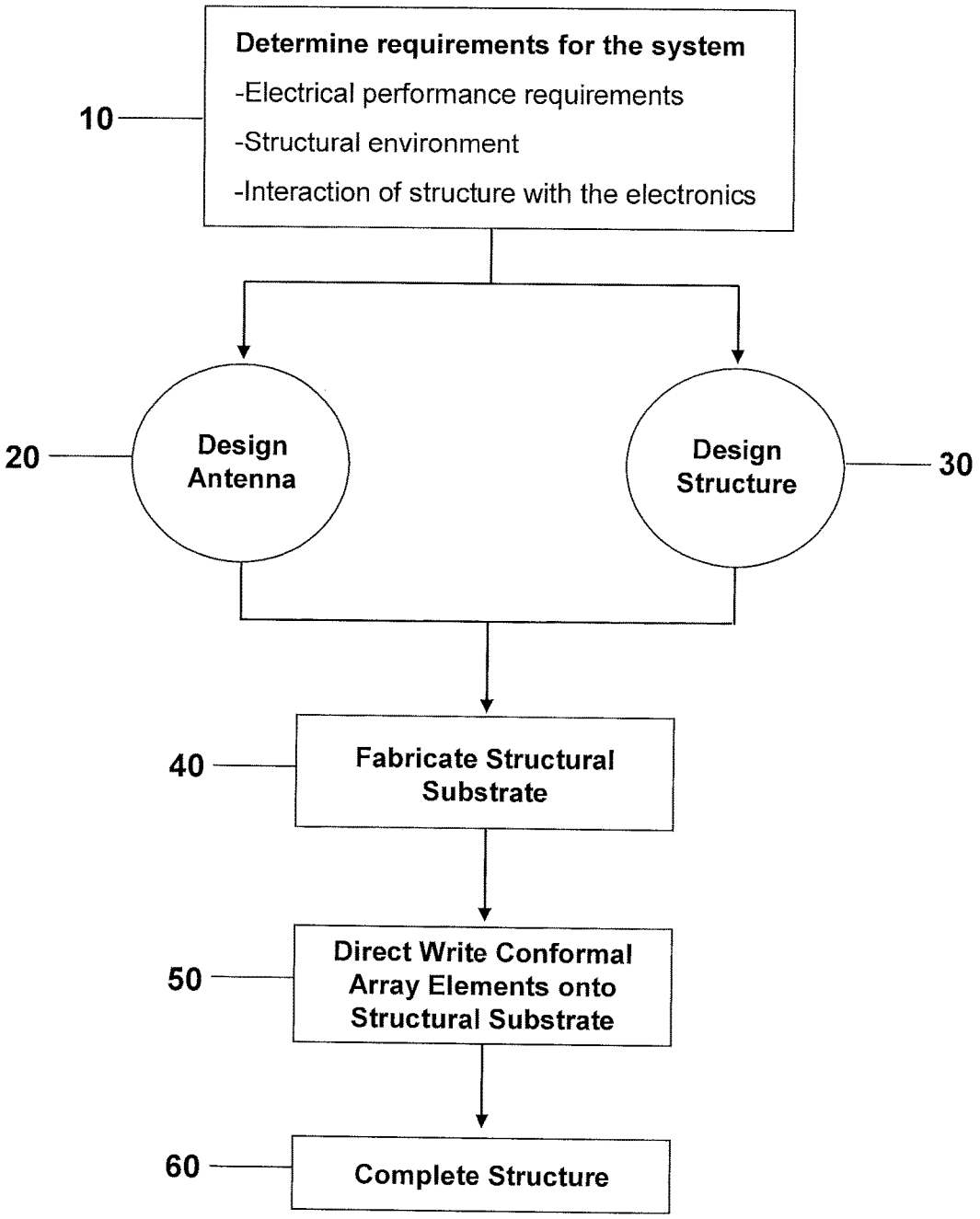
FIG. 2 is a flow diagram which illustrates an exemplary manufacturing process flow of the disclosed invention.

Thus, the disclosed invention provides a unique method of manufacturing multifunctional conformal electronic structures which integrates the overall structural and electronic designs into a single structure. An exemplary method for manufacture of the multifunctional conformal antenna array structure into an aircraft is shown in FIG. 2. To fabricate the multifunctional conformal antenna array structure, the requirements for the system may initially be determined as shown in FIG. 2 as step 10. The system requirements may include electrical performance requirements, structural environment, and the effects of interaction of the structure with the electronics. With this information, the design of the conformal electronics begins, shown as step 20. Concurrently, the structure into which the electronics will be incorporated is designed, shown as step 30. Issues such as frequency, bandwidth, dielectric constant and loss factor may be taken into account in the design and materials selection in order to obtain the required electronic signal from a sensor (e.g. the antenna element) to the primary electronics control system. Hence, both the electrical (20) and structural (30) designs may be interactively produced as materials and manufacturing methods are chosen. Thus, the structural materials can simultaneously serve to mechanically stiffen the wing of an aircraft and may also serve electronically as the ground plane for a conformal direct write antenna.

Once the multifunctional design has been completed, the initial structure may be fabricated, as shown in step 40, to form the support with which the electronics are integrated using direct write (and/or conventional) technologies, shown as step 50. A number of direct write processes, including ink jet, micropen, thermal spray, laser transfer and laser micromachining, may be used individually or combined together according to embodiments. The direct write processes selected may be capable of manufacturing conductor, dielectric/insulator and semiconductor devices on both flexible and/or complex three dimensional geometrical surfaces without damaging the substrate material of interest. After the electronics are fabricated, the remainder of the structure, if any, may be completed, thereby embedding and/or protecting the electronics. Assembly of several plies of structural substrate material may form the final multifunctional structure, shown as step 60.

Figure 3:
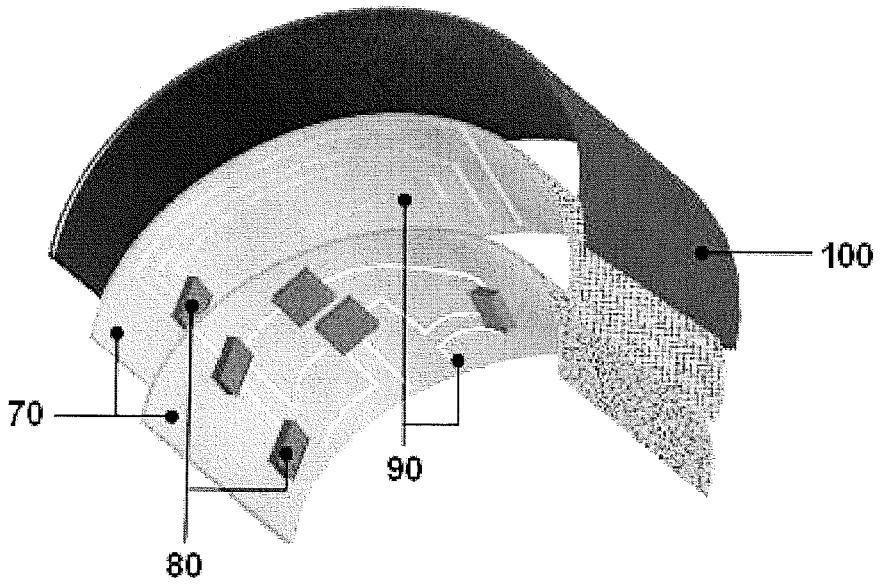
FIG. 3 is a schematic diagram which illustrates various embodiments of a multifunctional composite structure.

Exemplary electronics deposited onto a load-bearing material using methods of the present disclosure may include a GPS or communications antenna system, which includes the antenna element(s) and circuitry to support the antenna's operation, as shown in FIG. 3. Two plies of load-bearing material (70) are shown to have electronic elements integrated thereon (80, 90), Such elements may be laser transferred chips (80) and printed ink traces (90). These electronic elements are then covered by an outer protective composite ply (100). Assembly of these plies (70, 100) forms a multi-ply, multifunctional structure of an embodiment of the present disclosure.

Using methods of the present disclosure, the structure may be specifically designed to accommodate the needs and functioning of the electronics, and the electronics may be designed to accommodate the needs and functioning of the structure. Specifically, the structure is designed to have electronic functionality, and the electronics are designed to be load-bearing. For example, materials to build the structure may be chosen, in part, on the basis of their dielectric or conductive properties. Hence, a non-conductive composite material (e.g., quartz/cyanate ester) may be considered a "structural dielectric," serving as a support for the antenna's RF transmission lines or as a radome. Alternatively, a conductive composite material (e.g., graphite/epoxy) may be considered a "structural conductor," serving as a ground plane for the antenna elements or the antenna's electronics. Thus, the load-bearing materials or composites of the present disclosure may be chosen for their electronic and mechanical properties and may be referred to as "structural substrates."

Electronic elements (RF transmission lines, DC signal and power lines, semiconductor devices, resistors, capacitors, etc.) may be "printed" directly onto the structural substrate. In the prior art, electronics are often fabricated on an interposing substrate, such as a standard circuit board material like Kapton, FR-4 or Duroid. The completed circuit board is then embedded in the composite, but does not bear any structural load. An interposing substrate may be distinguished from a "structural substrate" or load-bearing ply of the present disclosure based at least on its inferior mechanical properties, physical dimensions (e.g., thickness), shape or areal density. As such, interposing materials may represent mechanical defects.

Methods of the present disclosure may be used to fabricate electronics directly on the load-bearing parts (e.g., quartz/cyanate ester composite plies) without interposing materials. Either direct write techniques, lithographic techniques, or both are used. Patterning may be achieved, for example, by three dimensional additive depositions of conductive, semi-conductive, and insulating materials as may be directed by a computer aided design file. Direct write techniques may comprise, for example, micropen dispensing, ink jet dispensing, thermal spray, laser transfer and laser "mill and fill." Examples of direct write materials include at least electrically-conductive silver ink, dielectric polymer ink, semiconductor materials, semiconductor devices and silicon chips, which can be conformally printed onto curved composite parts.

Etching of printed materials may be achieved using direct write laser micromachining. Alternatively, a structural substrate covered with copper film may be patterned by direct write printing of photoresist on the film and immersion of the film in an etchant bath. That is, adaptations of conventional electronics fabrication techniques may be used as needed to achieve the multifunctional structures of the present disclosure. As such, electronic elements may be formed directly on load-bearing composite parts, effectively rendering an aircraft wing a load-bearing antenna, for example.

Figure 4:
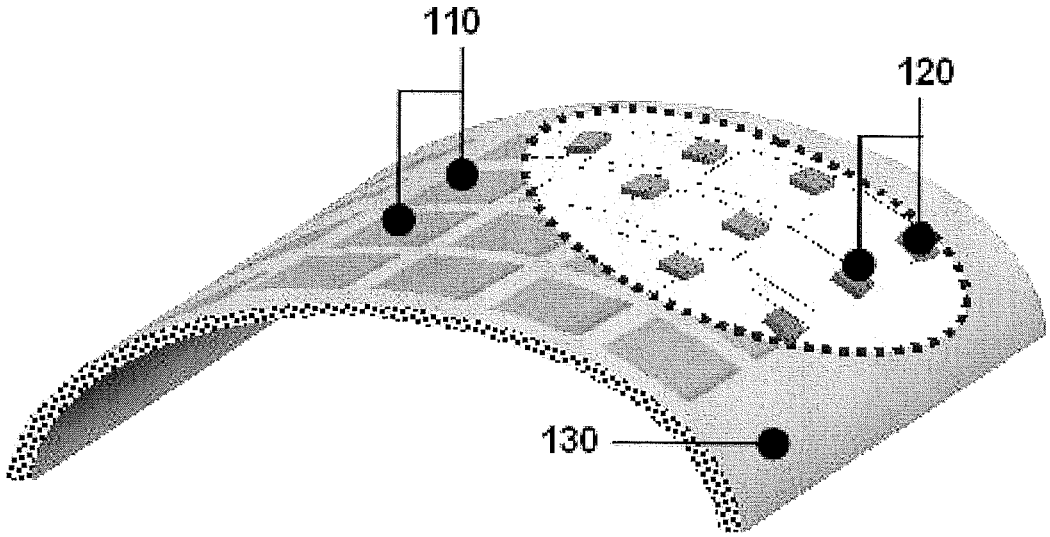
FIG. 4 is a schematic diagram illustrating various embodiments of a portion of a multifunctional fuselage.

The electronics formed on a load-bearing ply may be protected from the environment by other load-bearing composite plies laid above them, as shown in FIG. 4. For example, a curved aircraft surface (130), which is part of an aircraft fuselage, may have a structurally integrated phased array antenna system comprising conformal antenna elements (110) and laser transferred active devices (120, shown as a cutaway). That is, the amplifiers feeding each antenna array element have been integrated with conductive ink circuit traces on the fuselage. The other composite plies may or may not have electronics printed on them.

Thus, embodiments of the current disclosure also provide for an arbitrarily shaped load-bearing antenna system produced by a process comprising forming at least one antenna system component directly onto at least one ply of arbitrarily shaped load-bearing material without any interposers and assembling .at least two plies of arbitrarily shaped load-bearing material into a multifunctional structure which has an external surface. The plies are assembled in such a manner that the antenna system components do not reside on an external surface of the final arbitrarily shaped load-bearing antenna system. The multifunctional structure formed by this process functions as both an antenna system and a load-bearing structure.

The antenna system components may be selected from at least amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof. Further, the arbitrarily shaped load-bearing antenna structure may function as at least a global positioning system, communications system, data-link system, a telemetry system, radar system, directed energy system or RFID antenna system.

Yet another embodiment may include an arbitrarily shaped load-bearing antenna structure comprising at least two arbitrarily shaped load-bearing plies, wherein the first arbitrarily shaped load-bearing ply comprises at least one antenna system component formed directly on a first surface and the second arbitrarily shaped load-bearing ply is placed adjacent to and in close contact with the first surface of the first arbitrarily shaped load-bearing ply. In embodiments, the second arbitrarily shaped load-bearing ply may further comprise at least one antenna system component formed directly on a second surface, wherein the second surface of the second arbitrarily shaped load-bearing ply faces the first surface of the first arbitrarily shaped load-bearing ply.

In embodiments of the arbitrarily shaped load-bearing antenna, the antenna system components may include, but are not limited to, amplifiers, switches, transistors, resistors, circuits, logic circuits, memory elements, integrated circuits, capacitors, inductors, circulators, filters, diodes, conductors, semiconductors, magnetic materials, dielectrics, power lines, signal lines, transmission lines and combinations thereof. Further, the arbitrarily shaped load-bearing antenna structure may function as at least a global positioning system, communications system, data-link system, a telemetry system, radar system, directed energy system or RFID antenna system.

Hence, embodiments of the present disclosure enable the ability to manufacture electronic devices directly on conformal structural substrate materials which, when assembled, produce a multifunctional structure with greater performance than was previously possible.

Embodiments of the present disclosure provide a number of advantages. These benefits include, but are not limited to: 1) increased endurance of the vehicle, military equipment or protective gear into which the multifunctional structure is incorporated by eliminating protruding electronic elements or devices, 2) reduced weight of the vehicle, military equipment or protective gear by reducing the parasitic structures that were previously required to support the electronic devices, 3) increased performance of the electronic devices due to larger potential apertures and greater flexibility in the location on the vehicle, military equipment or protective gear, 4) reduced cost associated with maintenance and mean-time-to-failure due to reduced system complexity and 5) increased low observability of the vehicle, military equipment or protective gear on which the multifunctional structure is incorporated.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub combination.

It will be appreciated by persons skilled in the art that the disclosed invention is not limited to what has been particularly shown and described hereinabove. Rather the scope of the disclosed invention is defined by the appended claims and includes both combinations and sub combinations of the various features described hereinabove as well as variations and modifications thereof which would occur to persons skilled in the art upon reading the foregoing description.

What is claimed is:

1. A method of manufacturing an arbitrarily shaped multifunctional structure, the method comprising:

providing a plurality of arbitrarily-shaped load-bearing plies, wherein the plurality of arbitrarily-shaped load-bearing plies comprise at least a top ply layer and a bottom ply layer;

forming at least one electronic element directly onto a top of the bottom ply layer of at least one arbitrarily shaped load-bearing ply without employing any intervening structure using a direct-write or lithographic technique; and coupling the top ply layer to the bottom ply layer such that the plurality of arbitrarily shaped load-bearing plies are disposed in adjacent close contact with each other to form a multifunctional structure having an exterior and an interior, wherein the multifunctional structure is an electronic device and a load-bearing element and wherein the electronic element is disposed within the interior of the multifunctional structure.

2. The method of claim 1, wherein the multifunctional structure is conformal.

3. The method of claim 1, wherein the multifunctional structure is flexible.

4. The method of claim 1, wherein the top ply layer and the bottom ply layer are each formed of a composite material.

5. A method of manufacturing an arbitrarily shaped multifunctional structure, the method comprising:

providing a plurality of arbitrarily-shaped load-bearing plies, wherein the plurality of arbitrarily-shaped load-bearing plies comprise at least a top ply layer and a bottom ply layer;

forming at least one electronic element directly onto the bottom ply layer of at least one arbitrarily shaped load-bearing ply without employing any intervening structure using a direct-write or lithographic technique;

forming at least one electronic element directly onto the top ply layer of at least one arbitrarily shaped load-bearing ply without employing any intervening structure using a direct-write or lithographic technique; and coupling the top ply layer to the bottom ply layer such that the plurality of arbitrarily shaped load-bearing plies are disposed in adjacent close contact to form a multifunctional structure having an exterior and an interior, wherein the multifunctional structure is an electronic device and a load-bearing element and wherein the electronic elements are disposed within the interior of the multifunctional structure.

* * * * *